US007086394B2

(12) United States Patent
Smith et al.

(10) Patent No.: US 7,086,394 B2
(45) Date of Patent: Aug. 8, 2006

(54) GRINDABLE SELF-CLEANING SINGULATION SAW BLADE AND METHOD

(75) Inventors: David Walter Smith, Scottsdale, AZ (US); Robert Dee Graham, Phoenix, AZ (US); Brian Edward Pierson, Tempe, AZ (US)

(73) Assignee: Nexedge Corp., Phoenix, AZ (US)

( * ) Notice: Subject to any disclaimer, the term of this patent is extended or adjusted under 35 U.S.C. 154(b) by 0 days.

(21) Appl. No.: 10/780,223

(22) Filed: Feb. 17, 2004

(65) Prior Publication Data

US 2005/0178241 A1 Aug. 18, 2005

(51) Int. Cl.
*B28D 1/04* (2006.01)

(52) U.S. Cl. ..... 125/15; 51/307

(58) Field of Classification Search ..... 125/13.01, 125/15; 51/307; 205/109, 110, 666
See application file for complete search history.

(56) References Cited

U.S. PATENT DOCUMENTS

| | | | | | |
|---|---|---|---|---|---|
| 2,412,058 | A * | 12/1946 | Bessemer | 205/661 |
| 2,861,930 | A * | 11/1958 | Robinson | 205/680 |
| 3,957,593 | A * | 5/1976 | Haack | 205/110 |
| 5,588,419 | A * | 12/1996 | Elsbree | 125/15 |
| 5,702,492 | A * | 12/1997 | Elsbree | 51/307 |
| 6,098,609 | A * | 8/2000 | Ishizuka | 125/13.01 |
| 2003/0159555 | A1 * | 8/2003 | Perry | 83/13 |

* cited by examiner

*Primary Examiner*—M. Rachuba
(74) *Attorney, Agent, or Firm*—John B. Sowell

(57) ABSTRACT

A super abrasive impregnated singulation saw blade is made by depositing grindable friable super abrasive particles while electro depositing or electroless depositing a strong binder metal such as nickel on a form or mandrel. The deposited super abrasive on the upper side protrudes from the side of the blade and are ground down to or near the binder metal to plannerize the sides of the saw blade and true and balance the saw blade. Post operations include electro polishing to expose equal amounts of super abrasive on the cutting edge or on all sides. Antifriction particles may be added in the side walls or deposited on the outside.

13 Claims, 8 Drawing Sheets

Crystal Pullout

Crystal Micro

Crystal Macro

GRINDABLE SELF-CLEANING SINGULATION SAW BLADE AND METHOD

BACKGROUND OF THE INVENTION

1. Field of the Invention

The present invention relates to a new and improved super abrasive saw blade for separating packaged semiconductor devices one from another. More particularly, the present invention relates to a thin self-sharpening and self-cleaning singulation saw blade that cuts faster and lasts longer than prior art saw blades.

2. Description of the Prior Art

Saw blades for dicing silicon ingots and wafers are known. Most of these prior art blades are electro deposited, metal bonded by brazing or sintering or resin impregnated and contain natural or synthetic diamonds. None of these prior art blades are suitable for singulating or separating new high volume packaged devices that are mounted on lead frames or PC boards or substrates used in matrix array packaging.

Presently, high volume production packaged semiconductors are predominately small outline integrated circuit (SOIC) packages or Quad Flat Packs (QFP). Typical memory devices such as TSOP are die attached to lead frames to provide leaded plastic devices. The leads are then formed as flexible gull wing legs that are mounted on substrates or PC boards.

The new high volume production devices usually combine several functions on one chip. Such devices as personal digital assistants (PDA), small hand computers such as Palm Tops™, personal organizers, wireless phones with non-phone features and global positioning (GPS) devices all use new integrated functionability and require more complex electronics in one integrated package or chip. To meet the new requirement for integrated digital signal processing chips (DSP) and to continue increased data speeds while lowering cost and reducing size, new small DSP chips with high density and multiple functions are being manufactured in the form of matrix array leadless packaging. New matrix array leadless packages are known to be more cost effective to manufacture, however, the individual packages on some forms of carriers cannot be effectively separated one from another using silicon wafer dicing saw technology or other abrasive blade technology. Prior art dicing saw blades are designed to cut or grind through a wafer of silicon to separate die one from another and most use some form of liquid cooling agent or very pure water. In contrast thereto matrix array leadless packages such as Micro Lead Frame (MFL) packages and Quad, Flat, No-lead (QFN) all contain multiple layers which may comprise soft conductive metal, fiberglass and sheets of plastic that encapsulate the plural packages of a matrix array.

Diamond impregnated resinoid saw blades or metal bonded blades have been tried. They are thick (0.007 to 0.015 inches) and have high cost and short life and to some extent have excessive side wear.

Metal bonded and sintered compacted blades are also thick and tend to wear to a bullet nose shape creating a taper cut that is unacceptable because it changes the dimension of the package.

Thin electrodeposited dicing saw blades may tear and the cutting efficiency degrades quickly when cutting matrix array type materials. This degrade of cutting efficiency requires frequent blade replacement. Each time the blade is replaced it is restarted at a slower cutting feed rate.

The above-mentioned dicing saw blades tend to clog or load up with resin and soft metal. Clogged blades cut slower and increase heat at the edges of the blade which results in destruction of the packages or the soft metal and plastic becomes so hot that it smears. When the smears create burrs on the package they can be rejected for being out of specification. Some burrs may be removed in secondary operations to save the package or device at added cost.

Most of the above-mentioned dicing saw blades were found to cut slower, cost more, require removal and redressing and cannot be depended upon for a full production shift of manufacturing acceptable matrix array leadless packages.

Therefore, it is highly desirable to provide a new and improved singulation saw blade for separating packages in a matrix array, that cuts fast, is self-cleaning, cuts cool enough as not to always require a surfactant or water coolant, does not load or clog, does not produce out of specification burrs and is longer lasting.

SUMMARY OF THE INVENTION

It is a primary object of the present invention to provide a new self-sharpening singulation saw blade for cutting individual packages from matrix arrays containing glass, plastic and soft and hard metals.

It is a primary object of the present invention to provide a new method of making singulation saw blades used for cutting packages from matrix arrays.

It is a primary object of the present invention to provide a new self-cleaning singulation saw blade for cutting packages from matrix arrays that cuts fast and does not clog.

It is a primary object of the present invention to provide a new metal singulation saw blade that chemically and/or mechanically bonds to super abrasive particles and can be manufactured by an electroless or electro deposited method to bond to the super abrasive particles.

It is a primary object of the present invention to provide a new singulation saw blade with electrical and heat conductive super abrasive particles so that the particles hold stronger and conduct heat away from packages being cut.

It is a primary object of the present invention to provide a new nickel deposited metal singulation saw blade having friable super abrasive particles that macro fracture and/or micro fracture so that the worn particles are removed and present new sharp cutting edges.

It is a primary object of the present invention to provide a new nickel deposited metal singulation saw blade comprising super abrasive particles that are fracturable and grindable.

It is a general object of the present invention to provide a new and improved singulation saw blade made by depositing nickel or any other binder metals in the presence of super abrasive particles that are friable and breakable to expose new sharp cutting surfaces. The preferred blade is corrugated or provided with cooling passages to enable cool cutting and self cleaning.

According to these and other objects of the present invention a new and improved singulation saw blade is provided for cutting matrix array packages which contain hard and soft metal, plastic and glass fibre. The new blade is made by depositing a binding metal such as hard nickel around layers of friable super abrasive particles in the form of an annular ring. The blade or ring is preferably ground on the upper exposed side while supported to remove protruding super abrasive particles and to balance the side cutting forces on the saw blade. Preferably the blade is electro-polished on both sides to expose an equal amount of cutting edges.

DESCRIPTION OF THE PREFERRED EMBODIMENTS

Figure 1:
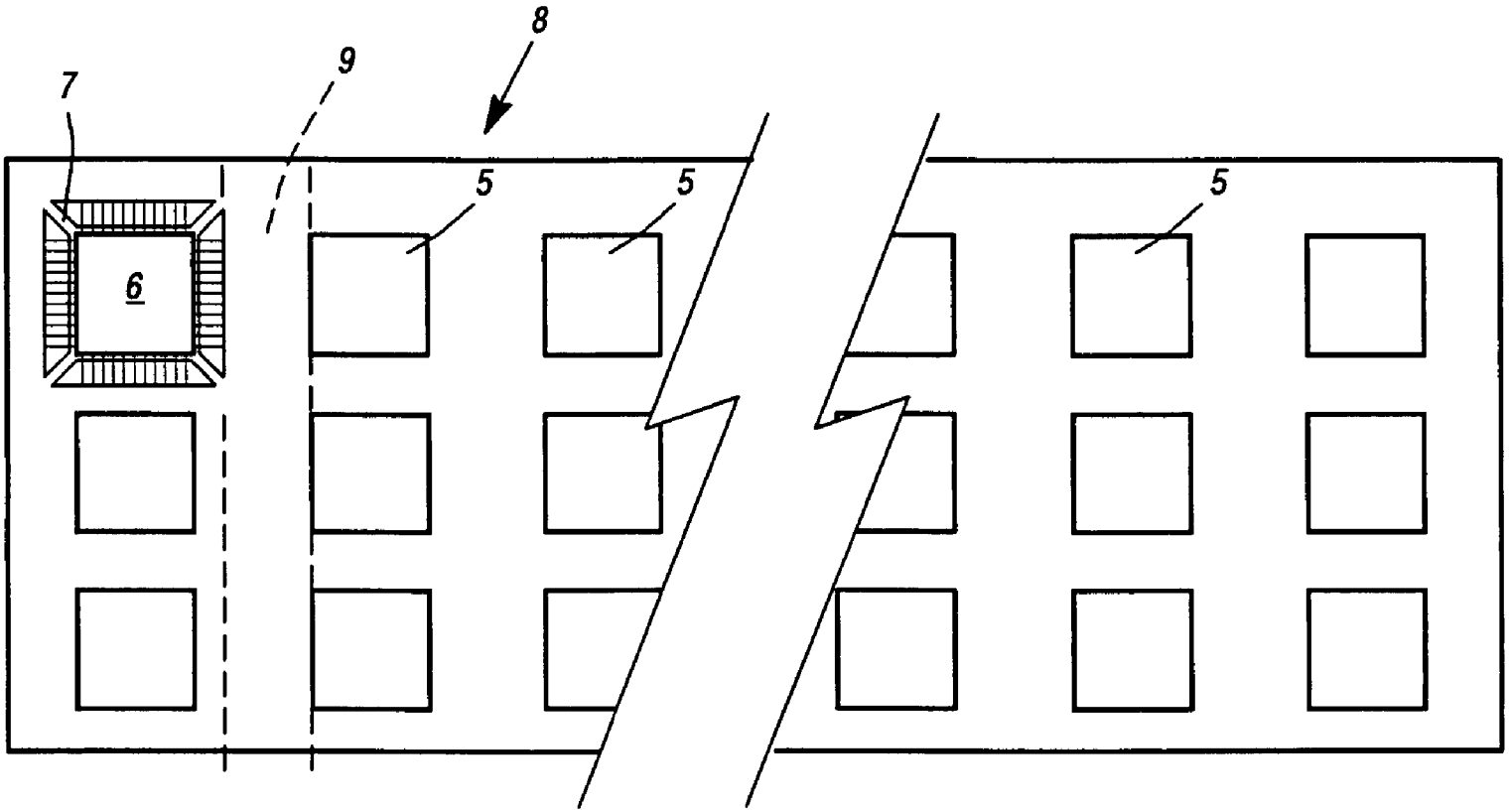
Figure 1 (Prior Art)
FIG. 1 is a plan view of a prior art array of semiconductor packages to be singulated one from another.

Refer now to FIG. 1 showing a plan view of semiconductor packages 5 containing die 6 that have been mounted on a common steel lead frame 7 or printed circuit board carrier in an array or matrix 8 ready to be singulated to provide packaged semiconductors (packages) ready for testing and final use. The packages are shown individually encapsulated in plastic. However, the top layer could be a continuous layer of plastic. The plastic is shown removed from the left uppermost die 6 showing wire bonds and/or leads that form part of the packaged semiconductor being singulated.

Typically the arrays 8 are two and one-half inches to three inches wide and up to ten inches long capable of supporting twelve to one thousand packaged devices. As greater numbers of packages are mounted on a single carrier, the street or distance between devices become more narrow and the saw cut used to singulate the devices becomes more critical. A common copper conductor 9 may be in the street.

Figure 2:
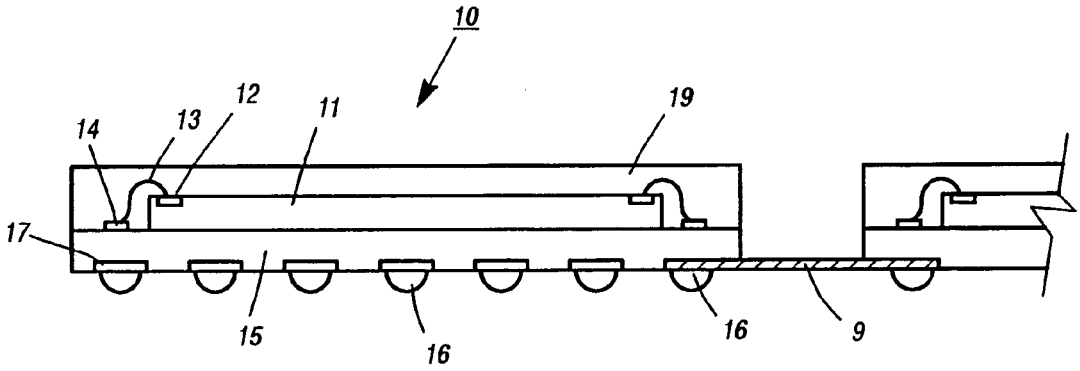
Figure 2 (Prior Art)
FIG. 2 is a sectional view of a single prior art package.

Refer now to FIG. 2 showing an elevation in section of a prior art Ball Grid Array (BGA) device or package 10. The die 11 is shown wire bonded at pads 12 and 14 by gold wires 13 to an interposer 15 having relatively large solder balls 16 on pads or sockets 17. In this BGA example, the large balls 16 adsorb lateral stresses due to miss match of thermal expansion. A non-hydroscopic cover of injection-molded epoxy 19 is employed to encapsulate the die 11. The interposer 15 serves a dual purpose. It can adapt numerous different sizes or types of die to PC boards or substrates (not shown) or can be employed as a fan out or distribution device to leads or targets on an assembly printed circuit board or larger substrate. Note that copper, steel, ceramic, PC boards with glass and plastic need to be cut to singulate a package from the array.

Figure 3:
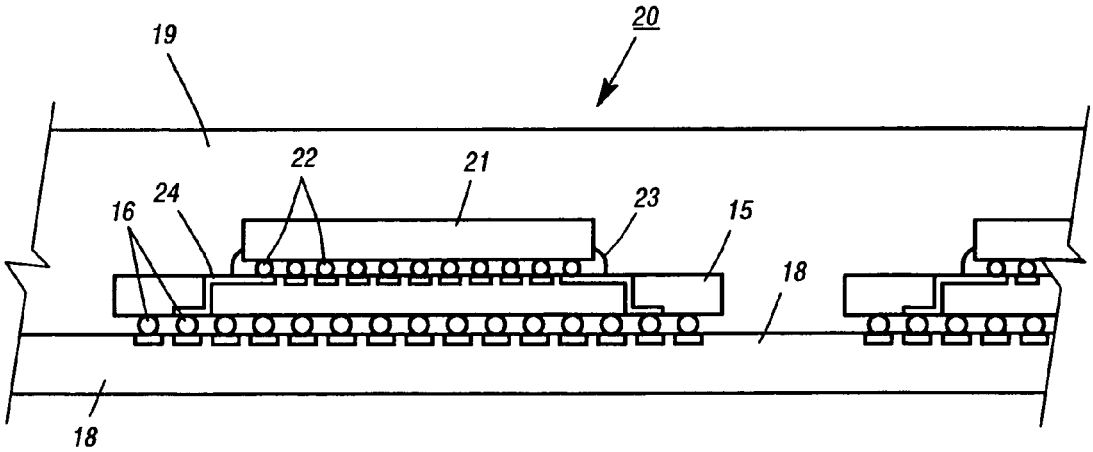
Figure 3 (Prior Art)
FIG. 3 is a sectional view of another prior art single package.

Refer now to FIG. 3 showing an elevation in section of a non wire bonded BGA package 20 employing a flip-chip semiconductor die 21 with small balls 22 connected to a BGA interposer adapter 15 having large balls 16 adapted to connect to a PC board or substrate 18. After the die 21 is tested it may be attached to an interposer 15 having legs 24 and distribution circuitry 24 shown connected to the large balls 16. It is common practice to employ an underfill 23 to alleviate shear stresses on the small balls 22. The die 21 may be tested after attachment to the interposer before or after underfill. The die 21 in the matrix 20 are tested before being attached to the mounting board 18 and are designed to be removed and replaced before being encapsulated in a layer of plastic 19 and then singulated from the matrix or strip 20.

Figure 4:
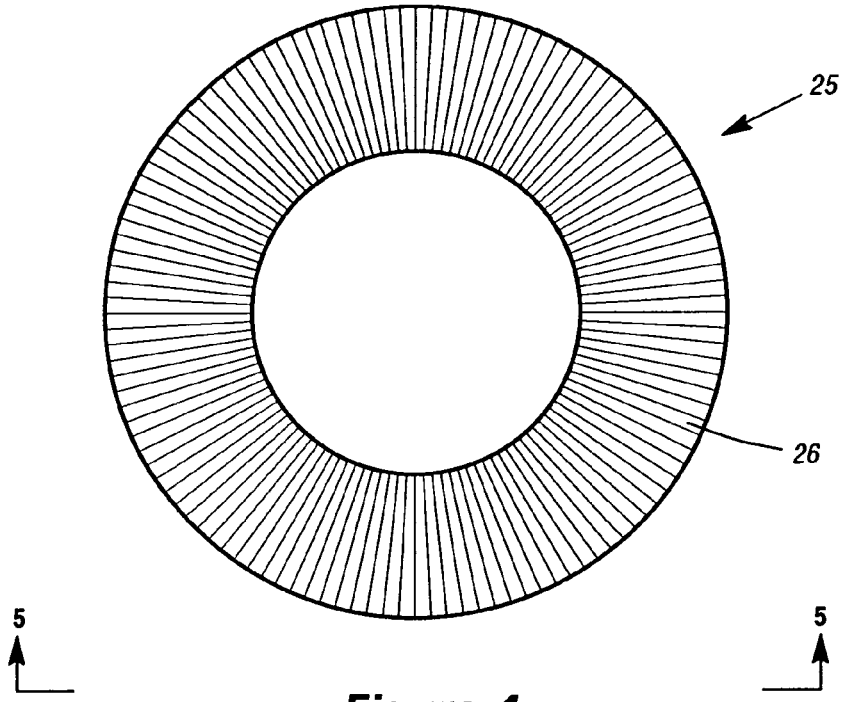
FIG. 4 is a plan view of the present invention singulation saw blade.

Refer now to FIG. 4 showing a plan view of one form of the present invention. Other self-cleaning forms are known in the prior art having various types of indentations or steps molded or pressed into a sintered abrasive mass which forms the cutting edge of the saw blade. The preferred embodiment saw blade 25 is shown in the form of an annular ring having steps 26. Singulation blades 25 may have one and one-half inch to five inch Outside Diameter (O.D.) and an inside diameter (I.D.) of one-half inch to four inches. The annular ring saw blade is made by electro or electro less depositing binder metal, preferably a hard nickel, while simultaneously depositing friable diamonds or super abrasives on a mandrel having the same desired shape of the finished saw blade. Thus, flat blades may be deposited on polished stainless steel sheets that are masked or on shaped mandrels.

Figure 5:
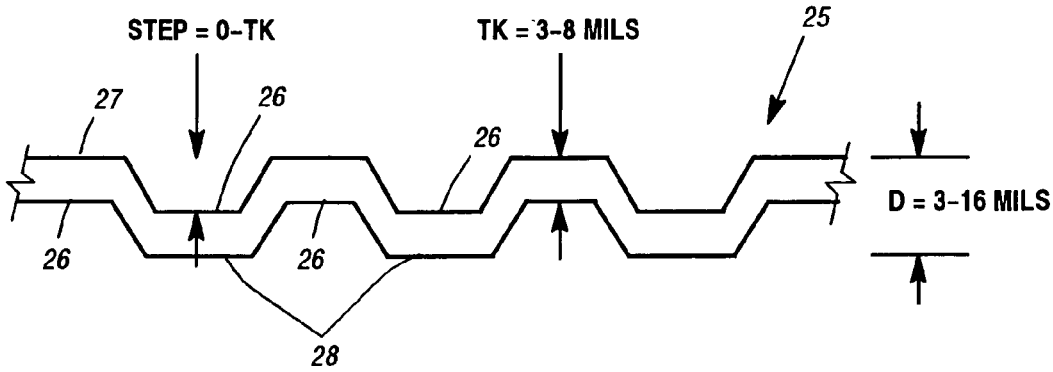
FIG. 5 is a marked up enlarged end view showing a preferred range of dimension for use on singulation saws.

Refer now to FIG. 5 showing an enlarged end view at arrows 5—5 of the electro deposited saw blade in FIG. 4. The steps 26 of the shaped saw blade 25 are shown to be symmetrical and that alternative steps 26 on the top and bottom sides of saw blade 25 are the same size. Up to about 120 radial fans have been made in a desirable singulation blade. The steps 26 vary from zero on a flat blade up to the thickness of a finished blade, preferably three to eight mils. Thus, the preferred depth does not exceed twice the thickness of an electro deposited blade. The bottom layer 28 is smooth with no protruding super abrasive particles. The upper layer 27 has protruding super abrasive particles firmly held by electro deposited nickel at least covering fifty percent of the diameter of the super abrasive particles. It is not necessary to plate a layer of nickel that completely covers the super abrasive particles and electro polish the sides 27, 28 to expose the tops of the super abrasive particles. It is a feature of the present invention to plate the minimum amount of nickel to hold the super abrasive particles and to grind away the friable super abrasives that protrude from the top layer 27. Natural diamonds are not friable and cannot be ground, however, synthetic diamonds can be made that are friable and grindable as will be explained hereinafter. Natural diamonds are approximately twice as hard as the next hardest synthetic super abrasives and the friable super abrasives all have faults and inclusions that make them test softer and less tough but allow them to be ground with softer grinding stones such as aluminum oxide. This ability to be ground results in better balanced saw blades made by fewer and lower cost steps.

Figure 6:
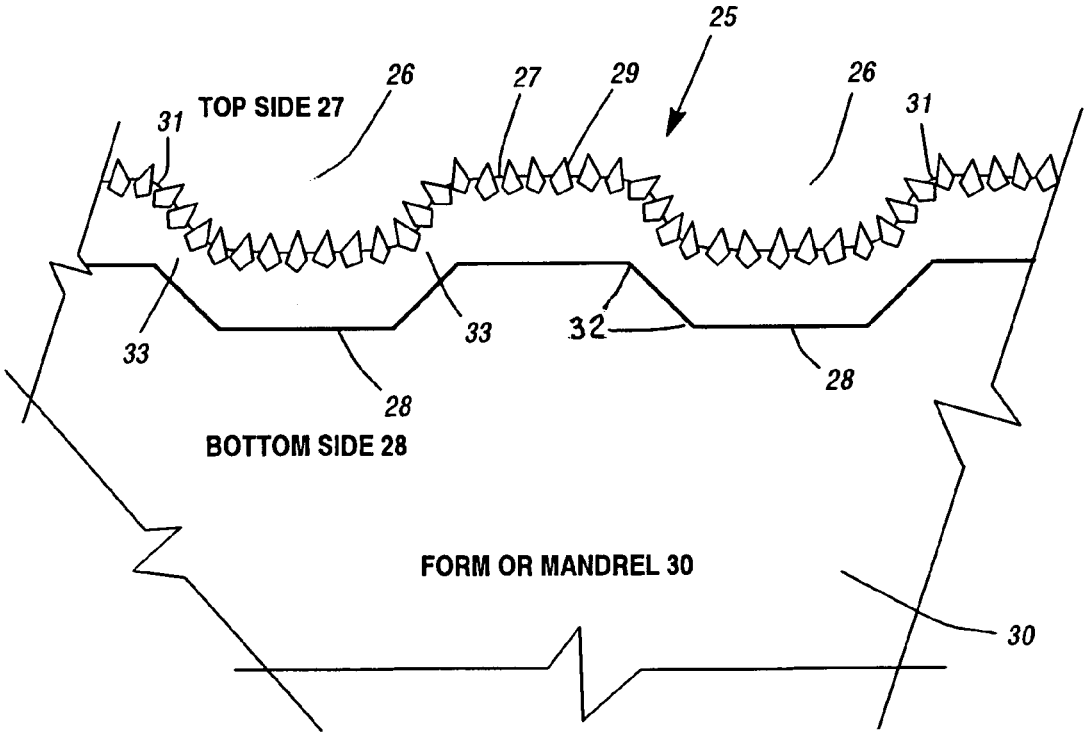
FIG. 6 is an enlarged end view of a part of the present invention singulation saw blade showing exposed super abrasive particles.

Refer now to FIG. 6 showing an enlarged end view similar to FIG. 5. When the saw blade 25 is removed from the mandrel. The saw blade 25 is out of balance. No super abrasive particles project from the bottom side 28, however, most of the particles 29 last deposited extend from the top side 27. There is no need to plate over the top layer of particles 29 by plating and not depositing super abrasive particles with the new singulation saw blade. The protruding particles 29 from the top layer 27 may be ground in one of three alternate ways.

The particles 29 are ground down to expose one to 10 microns above the top side 27. If balancing is required, the bottom side 28 is electro polished to expose the same amount of the particles 29 after grinding.

The particles 29 are ground down to or into the nickel leaving the top side 27 parallel to the bottom side 28,and the rounded edge 31, which occurs when nickel is plated, is removed. The fillet 32 on the bottom side 28 may be made very sharp to duplicate the contour of the mandrel. In any event, it has negligible effect on achieving a true balance of the cutting forces.

As shown in FIG. 6 there are super abrasive particles 29 exposed along transition portion 33 when the saw blade is first removed from the form or mandrel. It is easy to grind away particles 29 on the top side 27 but not so in the top step 26 or along the top of transition portion 33. Special tools may be made to grind or crush the particles 29 at these portions of the top side either before or after grinding the top side 27. The more expensive way of achieving near perfect balance would be to electro polish the whole bottom and to grind away the bottom side similar to the top side.

Having explained three ways to plannerize sides 27 and 28 and to balance and true the saw blade those skilled in the art of making dicing saw blades and singulation saw blades can interchange steps. In any event, grinding reduces plating time and does provide a truly balanced saw blade. When smaller abrasive particles are used in the layers at the top 27 side and bottom side 28 even greater balance with less grinding can be achieved.

Figure 7:
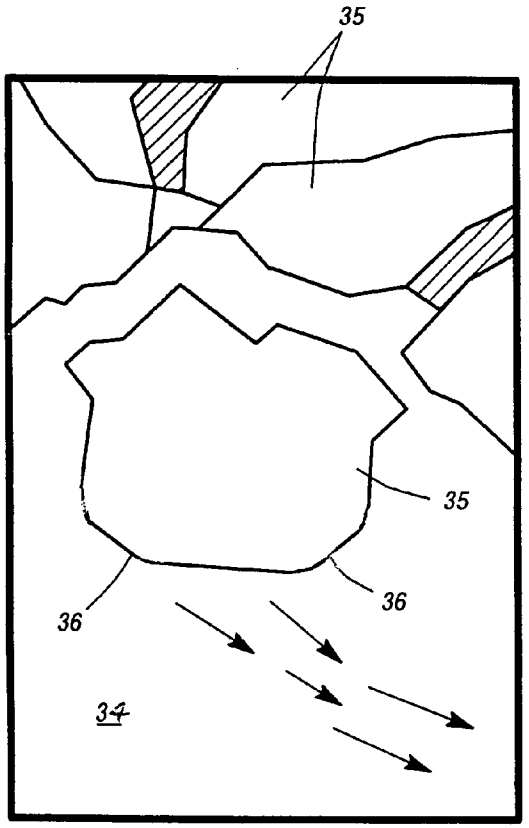
FIG. 7 is an enlarged section showing a portion of a blade in which the diamond in the metal matrix has worn and pulled out.

Refer now to FIG. 7 showing a greatly enlarged portion of the outer diameter of a nickel deposited saw blade 34 in which a non-friable very hard super abrasive crystal particle 35 is torn loose and pulled out of the saw blade 34. The saw blade 34 may comprise up to fifty percent diamonds or other very hard crystal abrasives 35. The stress of cutting hard materials wears down the sharp edges of a crystal 35 forming rounded edges 36 that are still very hard and tough. Rounding causes rubbing, the cutting efficiency decreases and therefore the force on the crystal 35 increases until they pull out. Pull out and subsequent dressing and truing accounts for about seventy percent of prior art resin bonded and metal bonding grinding wheels wear! When material diamond crystals wear they no longer cut clean and cause heat build up that produces soft metal smears and plastic burrs on sawn packages. Further, the grinding wheel and/or saw blade must be dressed frequently.

Figure 8:
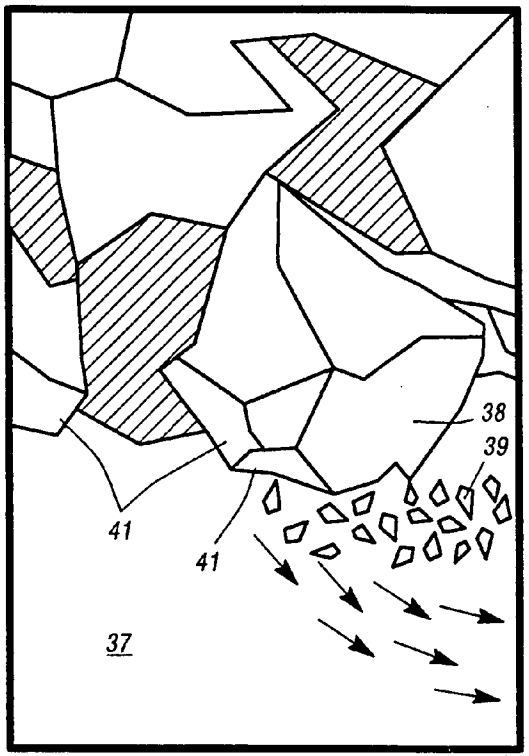
FIG. 8 is an enlarged section showing a portion of a blade in which a friable super abrasive particle has micro-fractured.

Refer now to FIG. 8 showing a greatly enlarged portion of the outer diameter of a nickel saw blade 37 in which a friable hard super abrasive crystal particle 38 has micro fractured causing the crystal wearing surface to break along fault and/or imperfection lines producing micro particles 39 and sharp tough sawing edges 41. Friable or fracturable crystals 38 are manufactured with imperfections by several manufacturers including GE and Super Abrasives Technology (SAT). If the package being singulated has hard lead frames as well as copper conductors inside, particles that micro fracture will cause the blade to be self-cleaning, self-truing and self sharpening. Further, when the blade is manufactured it is grindable on both sides, if needed, and on the outside diameter using grinding wheels.

Figure 9:
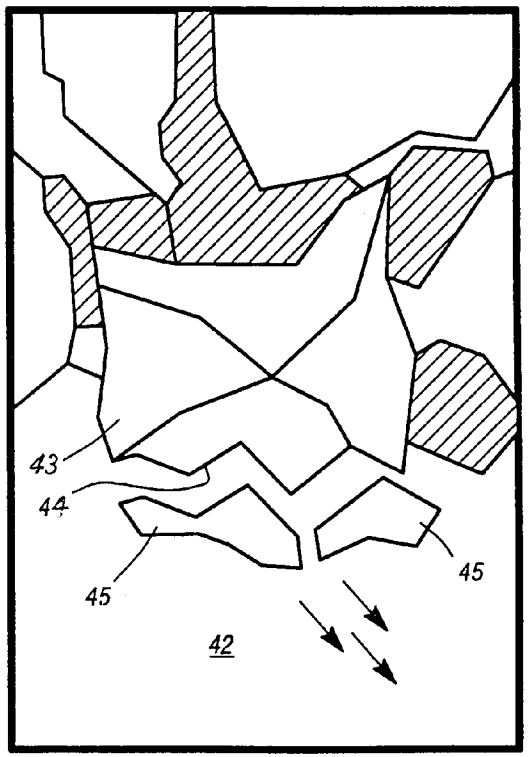
FIG. 9 is an enlarged section showing a friable super abrasive particles that has macro-fractured along crystal axis and maintained sharp cutting teeth.

Refer now to FIG. 9 showing a greatly enlarged portion of the outer diameter of a nickel saw blade 42 in which a friable hard super abrasive particle 43 has macro fractured causing the crystal wearing surface to cleave or break along fault or imperfection lines 44 producing macro particle 45 to break away from the crystal or particle 43. The imperfection lines 44 form sharp tough teeth that saw cut any known package. The mode of operation of sawing wherein the teeth 44 remove small bits of a package is preferred over using grinding wheels where heat and force smear both the plastic and metal.

Figure 10:
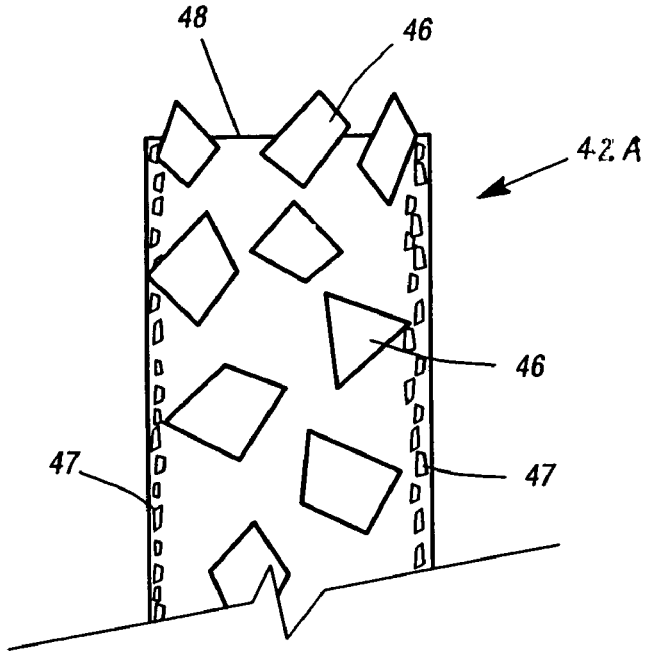
FIG. 10 is a section in elevation of the cutting edge of a modified saw blade.

Refer now to FIG. 10 showing a section in elevation of a modified saw blade 42A which comprises friable CBN particles 46. In this embodiment the saw blade 42A may include small diamonds or friable particles 47 that act as an anti-friction barrier. The small particles may be replaced with tough anti-friction particles of Teflon, aluminum or vacuum deposited layers which also serve as a mask during electro polishing the cutting edge 48 to expose the friable particles 46. The edge 48 is preferably ground and polished to square the cutting edge and meet manufacturer's specifications, but is easily dressed on the singulation saw with a grinding wheel or dressing tool. The blade shown in FIG. 10 will cut QFN packages faster and cleaner than prior art singulation saw blades and does not leave a burr.

Figure 11:
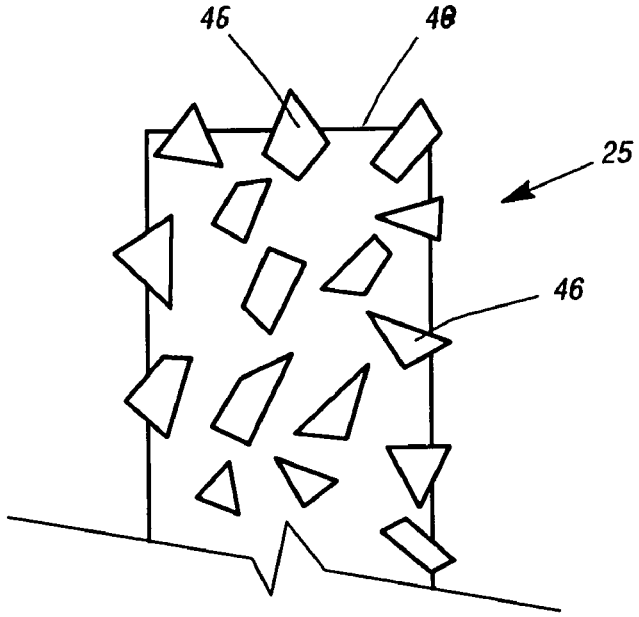
FIG. 11 is a section in elevation of the cutting edge of the preferred embodiment saw blade.

Refer now to FIG. 11 showing a section in elevation of the preferred embodiment singulation saw blade shown in FIGS. 4 to 6. As has been explained, this saw blade will cut all known forms of plastic leadless array packages and is manufactured at lower cost with fewer steps and/or elements. When the saw blade 25 is removed from its mandrel or form 30 it is a usable saw blade because it is self-cleaning and self-sharpening. However, truing and balancing the saw blade by grinding the top side 27 and electro polishing the deposited nickel has advantages in that the blade is "run in" and can be used at the highest speeds because it is balanced and truly symmetric. Small particles may be co-deposited throughout the saw blade 25 as explained hereinbefore without increasing the time to deposit the nickel.

Figure 12:
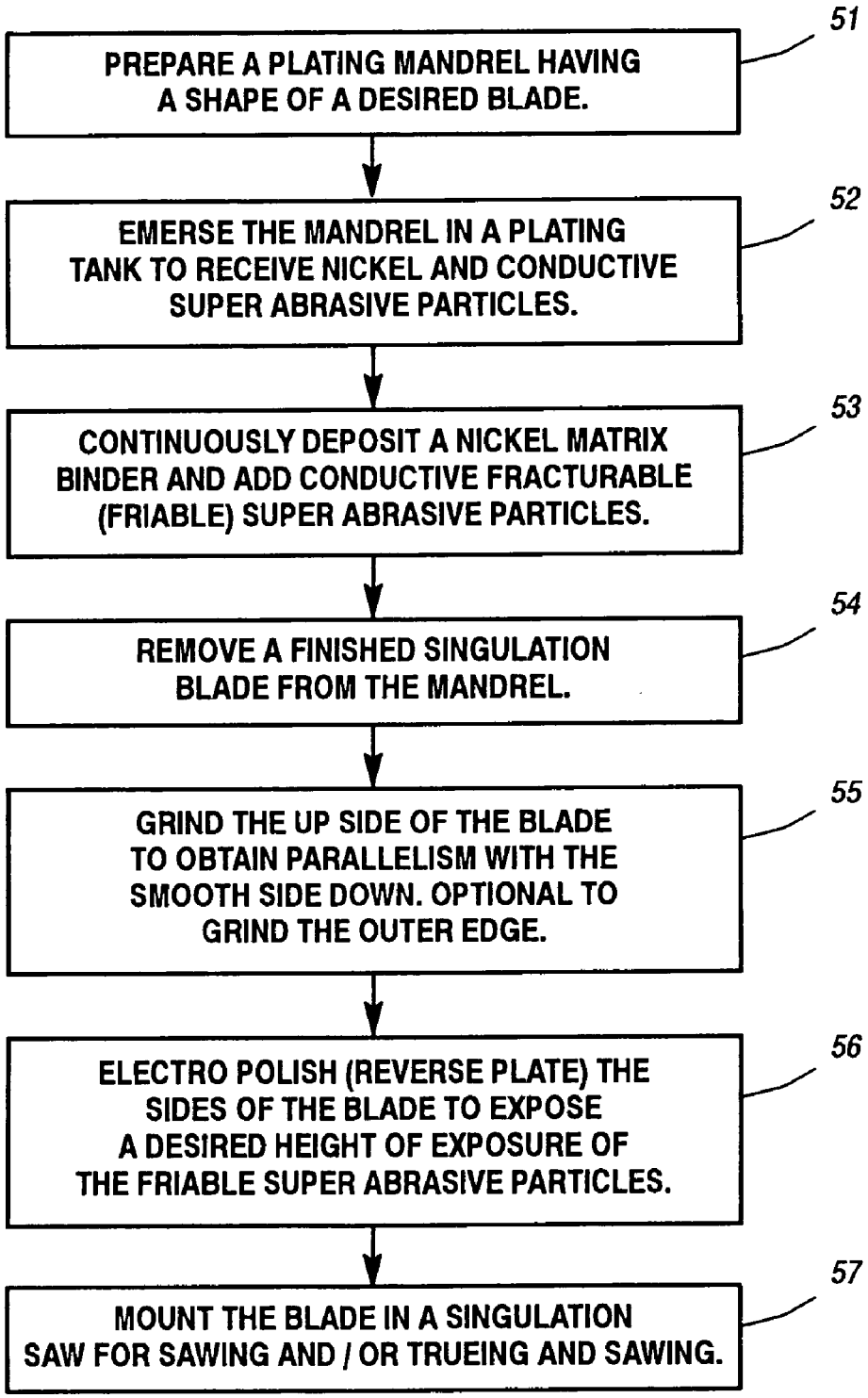
FIG. 12 is a flow diagram of steps that may be used to make the preferred embodiment saw blade.

Refer now to FIG. 12 showing a flow diagram of steps 51 to 57 used to make the preferred embodiment balanced saw blade 25 shown in FIGS. 4 to 6 and 11. It will be understood that the preferred embodiment uses electroless or electro-deposited nickel, however, the invention may be implemented with other deposited bonding metals. Steps 51 to 57 are self-descriptive and do not require additional explanation. Step 54 may include grinding on the mandrel.

Figure 13:
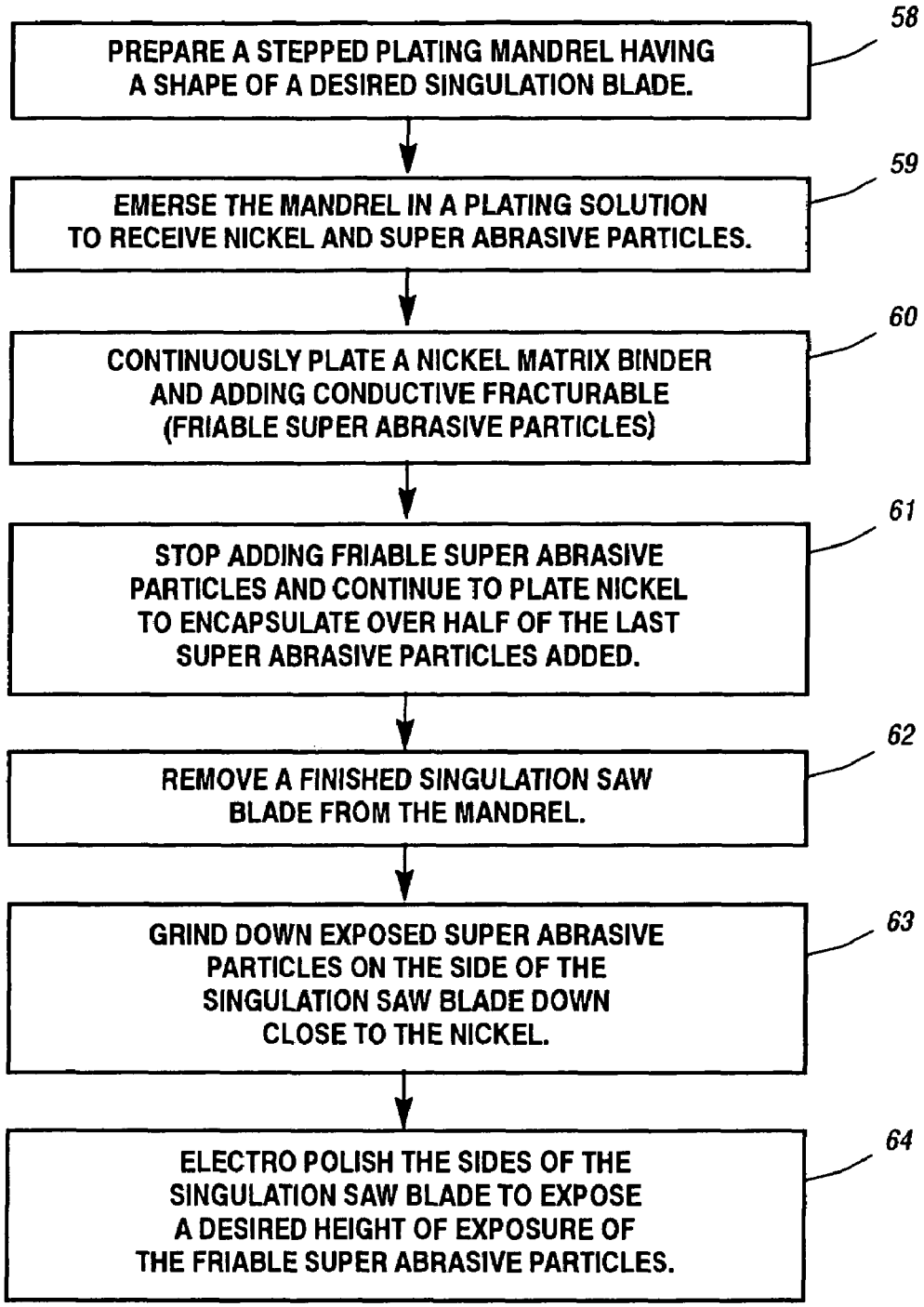
FIG. 13 is another flow diagram showing a sequence of steps similar to FIG. 12 used to made the novel saw blade.

Refer now to FIG. 13 showing a flow diagram of steps 58 to 64 used to make the modified saw blades of FIGS. 10 and 11. Most of the steps are the equivalent or the same as those shown in FIG. 12. Some of the steps may be considered optional, however, the object is to produce a saw blade that is ready for immediate use and does not require dressing on the singulation saw.

Having explained the problem involved in cutting semiconductor packages that include both hard and soft metals as well as fiberglass and plastic that cause blades to cut slow, wear, get dull, clog and create metal and plastic burrs and smears on the singulated packages, it will be appreciated that the present singulation saw blade cutting speed depends on what is being cut. Most packages have been cut at 1.5 to 3.0 inches per second and last for 60,000 inches or for a full eight-hour shift without truing and/or replacement.

Cubic Boron Nitride (CBN), garnet, sapphire, silicon carbide, tungsten carbide, cubic zircon, etc. can be made in friable form and may be preferred even though it is not as hard as friable synthetic diamonds. CBN crystals about 75 microns in size will cut hard substances without clogging even though crystals 5 to 150 microns in size can be used. Macro fracturable crystals are preferred to micro fracturable crystals as they cut faster and last longer.

The grindable and friable blades described may be made as thin as four one-thousandths of an inch wide thus allowing small waste. The electro deposited binder may vary in thickness, but most blades can be made with deposits of two to eight one-thousandths of an inch.

What is claimed is:

1. A method of making a balanced self-cleaning singulation saw blade, comprising the step of:

preparing a mandrel or form having contours with the shape of a desired saw blade, placing the mandrel in a depositing solution to receive friable particles and a deposited metal binder, depositing a continuous metal and friable particle saw blade on the mandrel greater than the desired thickness of the saw blade, removing the saw blade from the mandrel, grinding one side of the saw blade to obtain parallelism and to grind away protruding friable particles.

2. The method as set forth in claim 1 which further includes the step of electro polishing to expose cutting edges, and masking portions of the saw blade that are not to be electro polished.

3. The method as set forth in claim 2 wherein the step of masking comprises masking the sides and exposing the outside diameter to electro polishing.

4. The method as set forth in claim 3 wherein the step of electro polishing the outside diameter exposes up to fifty percent of said friable particles.

5. The method as set forth in claim 3 wherein the step of masking comprises depositing an anti-friction layer on the sides of the saw blade.

6. The method as set forth in claim 1 wherein the step of depositing a continuous metal and friable particle saw blade comprises electro depositing nickel and controlled amounts of friable particles while electroplating.

7. The method as set forth in claim 6 wherein the step of electroplating a continuous nickel and friable particle saw blade comprises depositing controlled amounts of large friable particles in the center of the saw blade and small particles on the sides of the saw blade.

8. The method as set forth in claim 6 wherein the step of electroplating a continuous nickel and friable particle saw blade comprises depositing five to 150micron friable particles.

9. The method as set forth in claim 6 wherein the step of electroplating a continuous nickel and friable particle saw blade comprises depositing 40 micron to 75 micron friable Cubic Boron Nitride (CBN).

10. A method of making a grindable self-adjusting singulation saw for sawing semiconductor packages containing hard and soft metals and plastic, comprising the steps of:

depositing binder metal on a form to provide an annular saw blade, encapsulating in the metal being deposited grindable super abrasive particles softer than natural diamonds to provide a grindable abrasive impregnated metal saw blade, said grindable super abrasive particles comprising friable synthetic Cubic Boron Nitride (CBN), and/or garnet sapphire, silicon carbide, tungsten carbide, cubic zircon, or the like, grinding one or more sides of the saw blade to balance and true the saw blade, and removing the annular saw blade from the form ready for use.

11. The method as set forth in claim 10 which further includes the step of balancing and truing the saw blade by electro polishing sides of the annular saw blade to expose grindable particles and super abrasive particles, and truing the outer diameter to a square balanced shape.

12. The method as set forth in claim 10 wherein the step of depositing metal comprises nickel.

13. The method as set forth in claim 10 which further includes encapsulating a controlled amount of anti-friction particles in the sidewall of the saw blade to create an anti-friction barrier.

* * * * *